US009156082B2

(12) United States Patent
Schlichting et al.

(10) Patent No.: US 9,156,082 B2
(45) Date of Patent: Oct. 13, 2015

(54) METHOD OF CONTINUOUSLY CASTING THIN STRIP

(71) Applicant: NUCOR CORPORATION, Charlotte, NC (US)

(72) Inventors: Mark Schlichting, Crawfordsville, IN (US); Charles Crabb, Blytheville, AR (US)

(73) Assignee: Nucor Corporation, Charlotte, NC (US)

( * ) Notice: Subject to any disclaimer, the term of this patent is extended or adjusted under 35 U.S.C. 154(b) by 126 days.

(21) Appl. No.: 13/909,713

(22) Filed: Jun. 4, 2013

(65) Prior Publication Data

US 2014/0352911 A1 Dec. 4, 2014

(51) Int. Cl.

| | |
|---|---|
| ***B22D 11/06*** | (2006.01) |
| ***B22D 11/12*** | (2006.01) |
| ***B22D 11/16*** | (2006.01) |

(52) U.S. Cl.

CPC ..... *B22D 11/0622* (2013.01); *B22D 11/12* (2013.01); *B22D 11/168* (2013.01)

(58) Field of Classification Search

CPC ..... B22D 11/0622; B22D 11/12
USPC ..... 164/480, 428
See application file for complete search history.

(56) References Cited

U.S. PATENT DOCUMENTS

| | | | |
|---|---|---|---|
| 5,584,337 | A | 12/1996 | Nakashima et al. |
| 5,720,335 | A | 2/1998 | Osada et al. |
| 5,762,126 | A | 6/1998 | Assefpour-Dezfully et al. |
| 5,901,777 | A | 5/1999 | Matsumura et al. |
| 5,960,855 | A | 10/1999 | Assefpour-Dezfully et al. |
| 5,960,856 | A | 10/1999 | Blejde et al. |
| 6,722,174 | B1 | 4/2004 | Nishii et al. |
| 6,745,607 | B2 | 6/2004 | Kato et al. |

(Continued)

FOREIGN PATENT DOCUMENTS

| | | |
|---|---|---|
| AU | 42235/96 | 8/1996 |
| AU | 2001291504 | 8/2002 |

(Continued)

OTHER PUBLICATIONS

English Machine Translation of Japanese Patent Publication No. 2006-272418.

(Continued)

*Primary Examiner* — Kevin P Kerns
(74) *Attorney, Agent, or Firm* — Hahn, Loeser & Parks, LLP; Arland T. Stein

(57) ABSTRACT

A method of improving control of thin strip produced by continuous casting including the steps of assembling a continuous casting apparatus having a pair of counter-rotating cooling rolls, having a nip there between and at least one enclosure downstream from the nip, introducing molten metal to form a casting pool supported on the cooling rolls above the nip and counter-rotating the cooling rolls forming cast strip downwardly from the nip, guiding the strip through the at least one enclosure downstream from the nip, the at least one enclosure having gas inlets for directing oxygen-containing gas into the enclosure, and directing oxygen-containing gas having a desired amount of oxygen through the inlets into the enclosure to provide an atmosphere 0.5% and 15% oxygen with between 3 and 10% humidity to oxidize at least one surface of the strip a desired thickness of scale on the surface of the strip to provide less mill force and downstream control of the strip.

14 Claims, 7 Drawing Sheets

(56) References Cited

U.S. PATENT DOCUMENTS

| | | | | |
|---|---|---|---|---|
| 6,766,934 | B2 | 7/2004 | Ziegelaar et al. | |
| 6,776,218 | B2 | 8/2004 | Glutz et al. | |
| 6,920,912 | B2 | 7/2005 | Blejde et al. | |
| 7,984,748 | B2 | 7/2011 | Dixon et al. | |
| 2002/0043357 | A1 | 4/2002 | Strezov et al. | |
| 2003/0014163 | A1 | 1/2003 | Ziegelaar et al. | |
| 2004/0123973 | A1* | 7/2004 | Blejde et al. | 164/480 |
| 2006/0156778 | A1 | 7/2006 | Ondrovic et al. | |
| 2007/0199627 | A1 | 8/2007 | Blejde et al. | |
| 2007/0220939 | A1 | 9/2007 | Britanik et al. | |
| 2008/0276679 | A1 | 11/2008 | Eckerstorfer et al. | |
| 2009/0126896 | A1 | 5/2009 | Blejde et al. | |
| 2009/0139290 | A1 | 6/2009 | Britanik et al. | |
| 2010/0032128 | A1 | 2/2010 | Schlichting et al. | |
| 2011/0132568 | A1 | 6/2011 | Schlichting et al. | |
| 2011/0253336 | A1 | 10/2011 | Dixon et al. | |
| 2011/0303386 | A1 | 12/2011 | Blejde et al. | |

FOREIGN PATENT DOCUMENTS

| | | |
|---|---|---|
| EP | 1145777 | 10/2001 |
| EP | 1987900 | 11/2008 |
| GB | 2334464 | 8/1999 |
| JP | 2006-272418 | 10/2006 |
| JP | 2010-179321 | 8/2010 |
| KR | 10-2011-0071627 | 6/2011 |
| WO | 97/34718 | 9/1997 |
| WO | 01/32335 | 5/2001 |

OTHER PUBLICATIONS

English Machine Translation of Japanese Patent Publication No. 2010-179321.

* cited by examiner

METHOD OF CONTINUOUSLY CASTING THIN STRIP

BACKGROUND AND SUMMARY

This invention relates to the casting of metal strip by continuous casting in a twin roll caster.

In a twin roll caster, molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a transition piece to a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

When casting steel strip in a twin roll caster, the strip leaves the nip at very high temperatures of the order of 1400° C. and can suffer very rapid scaling due to oxidation at such high temperatures in an air atmosphere. Such excessive scaling of the strip may result in significant rolled-in scale.

To deal with the problem of rapid scaling of strip emerging from a twin roll strip caster, the newly formed strip has been maintained within a sealed enclosure, or a succession of such sealed enclosures, in which a controlled atmosphere or atmospheres is maintained in order to inhibit oxidation of the cast strip. The controlled atmosphere can be produced by delivering non-oxidizing gases to the sealed enclosure or successive enclosures. However, uneven scaling across the strip can cause uneven friction between the strip and work rolls, and uneven steering of the strip through the rolling mill and downstream to the coiler.

Disclosed is a method of selectively oxidizing on the cast strip surface or surfaces to desirably oxidize the cast strip surface or surfaces, decreasing the friction coefficient of the cast strip. The decreased friction coefficient and more even friction coefficient across the strip decreases mill loads for a given reduction in strip thickness decreasing production costs, and produces strip with smoother surfaces providing higher strip yield for an intended purpose. Also with a decreased and more even friction coefficient, control of strip steering at rolling mill and pinch roll upstream from the coiler is improved resulting in more even strip coiling, and less risk of deformities such as camber and less risk of excessive telescoping in coils.

Disclosed is a method of improving control of thin strip produced by continuous casting comprising:

a) assembling a continuous casting apparatus having a pair of counter-rotating casting rolls, positioned to provide a nip there between, and at least two enclosures downstream from the nip, b) introducing molten metal to form a casting pool supported on the casting rolls above the nip and counter-rotating the casting rolls to form thin metal strip downwardly from the nip, c) guiding the strip through a first enclosure downstream from the nip, and a set of pinch rolls into a second enclosure providing entry to a rolling mill, and d) directing oxygen-containing gas having a desired amount of oxygen through the inlets into the second enclosure to provide an atmosphere of 0.5 and 15% oxygen with humidity between 3% and 10% in the second enclosure to oxidize at least one surface of the strip to form a desired more even thickness of scale on the surface of the strip providing reduced mill load, smoother strip surfaces and more stable downstream steering control of the strip.

The atmosphere in the second enclosure may comprise between 3% and 7% oxygen inclusive or between 5% and 10 or 15% oxygen, and the humidity in the second enclosure may be between 3% and 5%. Also, the scale on the strip may have a thickness of between 0.05 and 4.0 microns, or between 0.2 and 2.0 microns.

In some embodiments, the gas inlets may be disposed in the top portion or bottom portion of the second enclosure directing oxygen-containing gas downwardly or upwardly respectively toward the surface of the strip. In other embodiments, the gas inlets may be positioned in the top portion and bottom portion of the second enclosure directing oxygen-containing gas both downwardly and upwardly toward both the upper and lower surfaces of the thin metal strip. In such embodiments, the gas inlets may be a top and/or a bottom header comprising at least one nozzle in the top and/or bottom portion of the second enclosure adapted to direct oxygen-containing gas downwardly and/or upwardly toward the surface of the thin metal strip as desired.

The gas inlets in the second enclosure may be adapted to deliver oxygen-containing gas to the enclosure in an amount sufficient to form between 0.05 and 4.0 microns or between 0.2 and 2.0 microns of scale on at least one surface of the thin metal strip and to provide a positive pressure within the second enclosure inhibiting ingress of atmospheric air.

Also disclosed is an apparatus for continuously casting thin metal strip comprising:

a) a continuous caster having a pair of counter-rotatable casting rolls laterally positioned to form a nip therebetween through which thin metal strip can be downwardly cast and a metal delivery system adapted to deliver molten metal between the casting rolls above the nip, b) at least one enclosure positioned downstream from the nip adapted to permit movement of the cast strip therethrough and providing entry to a rolling mill, and c) gas inlets adapted to deliver oxygen-containing gas having a desired amount of oxygen into said enclosure to provide an atmosphere of 0.5% and 15% oxygen with humidity between 3% and 10% in the second enclosure, adapted to oxidize at least one surface of the thin metal strip to form scale on the strip to a desired scale thickness on the strip surface to provide less mill loading, smoother strip surfaces, and more stable steering control of the strip downstream from the enclosure.

In some embodiments, the gas inlets may be adapted to deliver oxygen-containing gas having a desired amount of oxygen into the enclosure to oxidize at least one surface of the thin metal strip to form scale on the strip to a desired thickness of between 0.05 and 4.0 microns to provide less mill loading, smoother strip surfaces and steering control of the strip downstream from the enclosure. In other embodiments, the gas inlets may be adapted to deliver oxygen-containing gas having a desired amount of oxygen into said enclosure to oxidize at least one surface of the cast strip to form scale on the thin metal strip to a desired thickness of between 0.2 and 2.0 microns, to provide less mill loading, smoother strip surfaces and steering control of the strip downstream from the enclosure. The atmosphere of said enclosure may be controlled to be between 3 and 7% or between 5 and 10 or 15% oxygen, with the humidity in the second enclosure may be between 3% and 5%.

In some embodiments, the enclosure may have gas inlets in the bottom portion or top portion of said enclosure adapted to deliver oxygen containing gas upwardly or downwardly into the enclosure to oxidize at least one surface of the strip to provide less mill loading, smoother strip surface, and more stable steering control of the strip downstream from the enclosure. In other embodiments, the enclosure may have gas inlets in the top portion and bottom portion of the enclosure adapted to deliver oxygen containing gas downwardly and upwardly into the enclosure toward the thin metal strip to oxidize both the upper and lower opposed surfaces of the strip to provide less mill loading, smoother strip surfaces and more stable steering control of the strip downstream from the enclosure.

In some embodiments, the enclosure may have a lower pressure than components upstream from the enclosure and may have a higher pressure than components downstream from the enclosure, inhibiting the flow of gases upstream in the system. Alternatively, or in addition, the enclosure may have a higher pressure than the external ambient atmosphere inhibiting the ingress of gasses from adjacent external atmospheres into the enclosure.

Other details, objects and advantages of the invention will become apparent as the following description of embodiments of the invention proceeds.

BRIEF DESCRIPTION OF DRAWINGS

The accompanying drawings illustrate the operation and practice of a thin strip caster, in which.

DETAILED DESCRIPTION OF THE DRAWINGS

Figure 1:
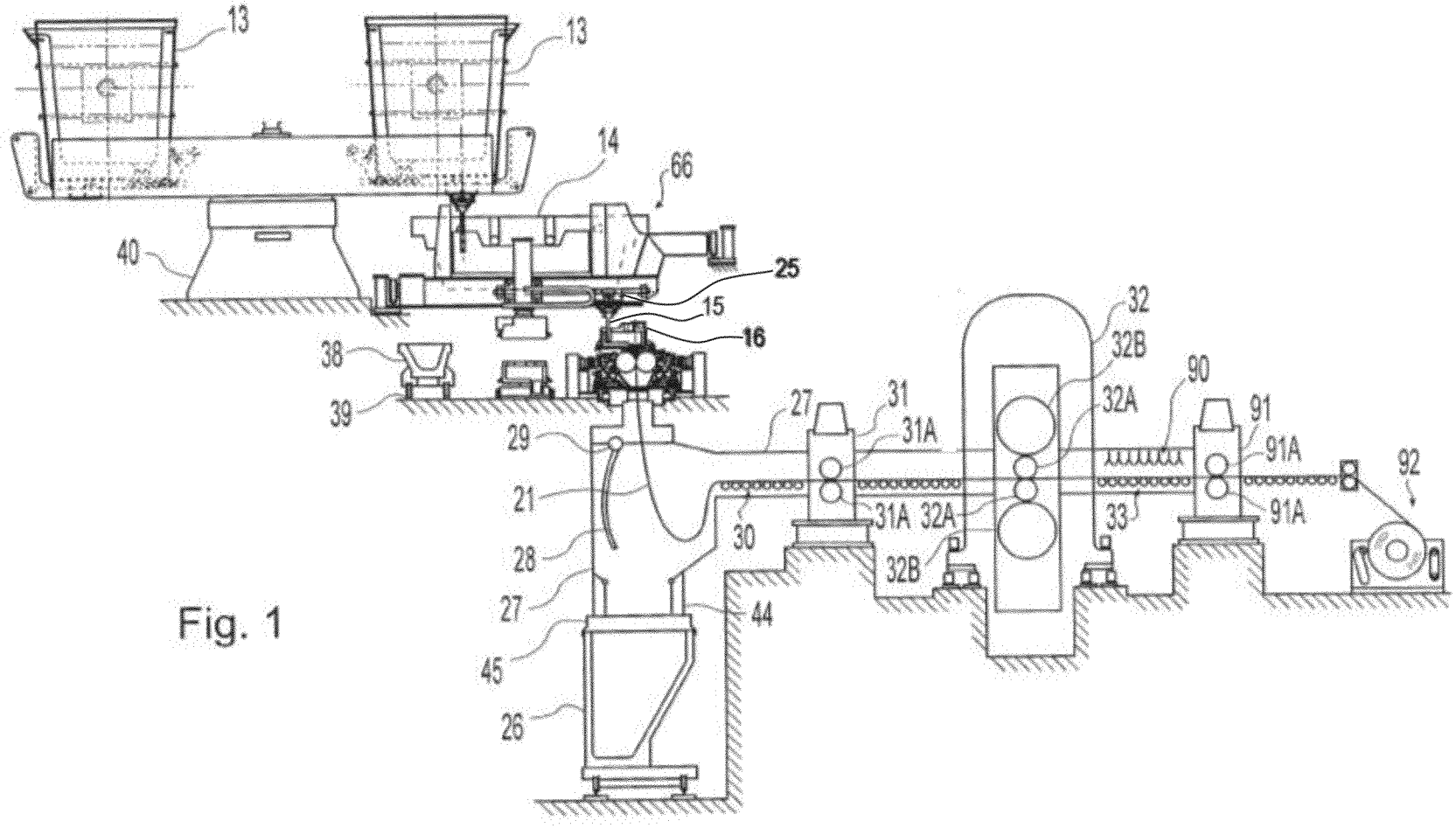
FIG. 1 is a diagrammatical side view of a twin roll caster system of the present disclosure.
Figure 2:
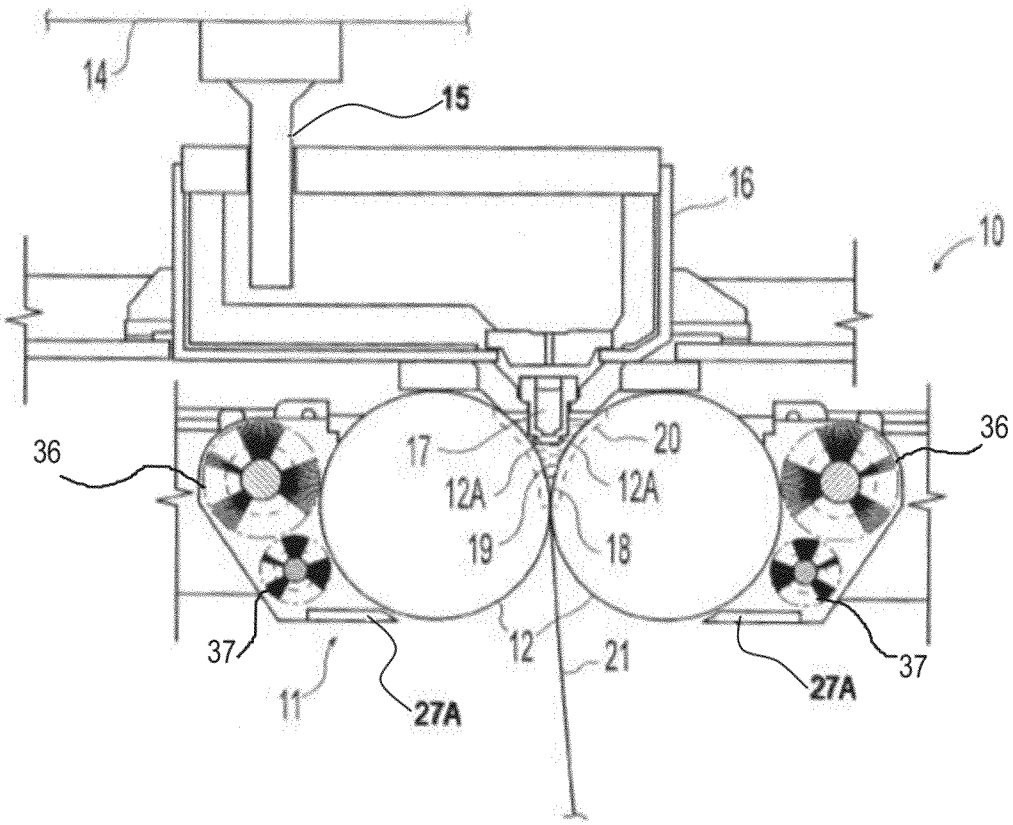
FIG. 2 is a partial sectional view through the casting rolls mounted in a roll cassette in the casting position of the twin roll caster of FIG. 1.

Referring now to FIGS. 1 and 2, a twin roll caster is illustrated that comprises a main machine frame 10 that stands up from the factory floor and supports a pair of casting rolls mounted in a module in a roll cassette 11. The casting rolls 12 are mounted on the roll cassette 11 for ease of operation and movement as described below. The roll cassette facilitates rapid movement as a unit of the casting rolls ready for casting from a setup position into an operative casting position in the caster, and ready removal as a unit of the casting rolls from the casting position when the casting rolls are to be replaced. There is no particular configuration of the roll cassette that is desired, so long as it performs that function of facilitating movement and positioning of the casting rolls as described herein.

Referring to FIGS. 1 and 2, the casting apparatus for continuously casting thin steel strip includes a pair of counter-rotatable casting rolls 12 having casting surfaces 12A laterally positioned to form a nip 18 therebetween. Molten metal is delivered from a ladle 13 through tundish 14, then through shroud 15 to transition piece 16, and then to a metal delivery nozzle 17, or core nozzle, positioned between the casting rolls 12 above the nip 18. Molten metal thus delivered forms a casting pool 19 of molten metal supported on the casting surfaces 12A of the casting rolls 12 above the nip. This casting pool 19 is confined in the casting area at the ends of the casting rolls 12 by a pair of side closures or side dams 20 (shown in dotted line in FIG. 2). The upper surface of the casting pool 19 (generally referred to as the "meniscus" level) may rise above the lower end of the delivery nozzle 17 so that the lower end of the delivery nozzle is immersed within the casting pool 19. The casting area includes the addition of a protective atmosphere above the casting pool 19 to inhibit oxidation of the molten metal in the casting area.

The delivery nozzle 17 is made of a refractory material such as alumina graphite. The delivery nozzle 17 may have a series of flow passages adapted to produce a suitably low velocity discharge of molten metal along the rolls and to deliver the molten metal into the casting pool 19 without direct impingement on the roll surfaces. The side dams 20 are made of a strong refractory material and shaped to engage the ends of the rolls to form end closures for the molten pool of metal. The side dams 20 may be moveable by actuation of hydraulic cylinders or other actuators (not shown) to bring the side dams into engagement with the ends of the casting rolls.

Referring now to FIG. 1, the ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station, where the tundish is heated to near a casting temperature, to the casting position. A tundish guide is positioned beneath the tundish car 66 to enable moving the movable tundish 14 from the heating station to the casting position. The tundish car 66 may include a frame adapted to raise and lower the tundish 14 on the tundish car 66. The tundish car 66 moves between the heating position to a casting station. At least a portion of the tundish guide may be overhead from the elevation of the casting rolls 12 mounted on roll cassette 11 for movement of the tundish between the heating station and the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. The distributor 16 is made of a refractory material such as, for example, magnesium oxide (MgO). From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought together at the nip 18 between the casting rolls to produce a solidified thin cast strip product 21 delivered downwardly from the nip. FIG. 1 shows the twin roll caster producing the thin cast strip 21 in first enclosure 27, where the strip passes across a guide table 30 to a pinch roll stand 31, comprising pinch rolls 31A.

Figure 3:
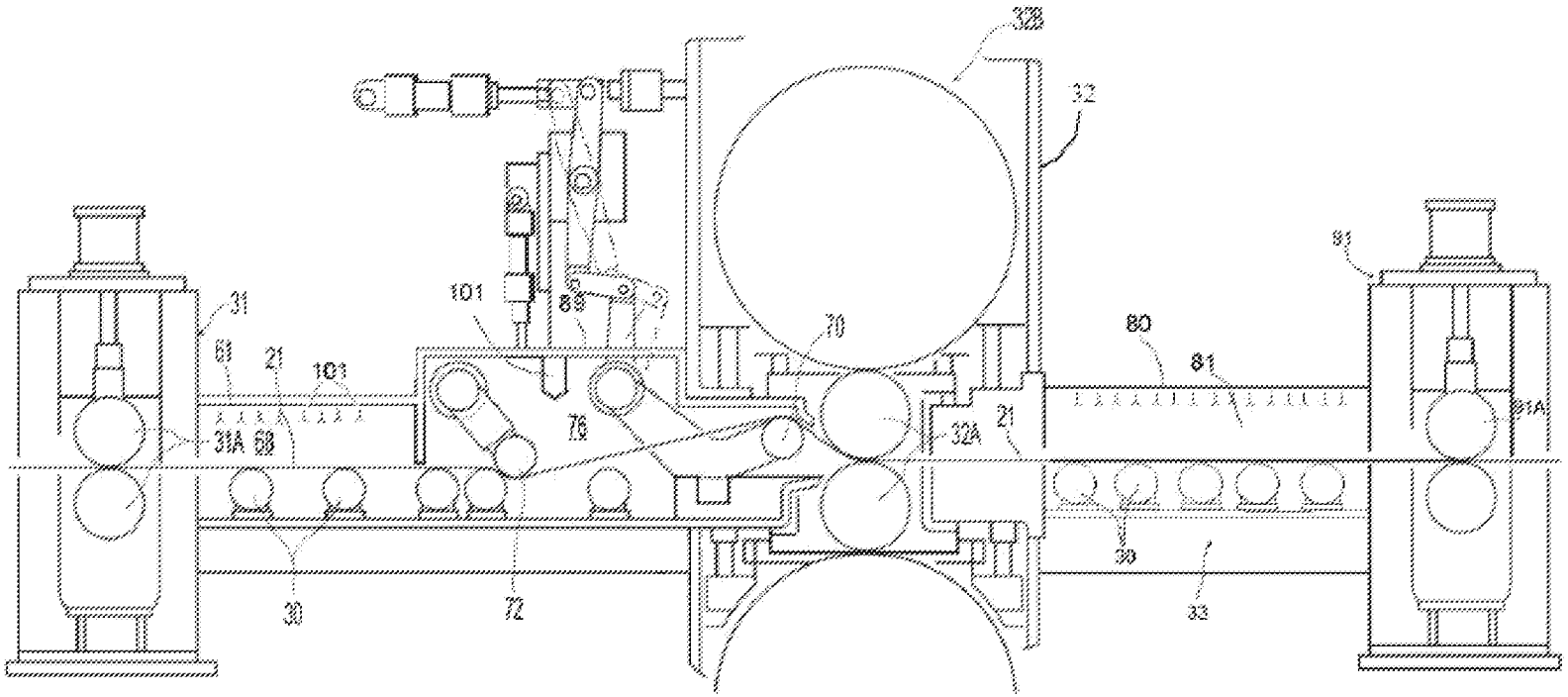
FIG. 3 is a partial sectional view of the twin roll caster system shown in FIG. 1 from the first pinch rolls through a second enclosure and optionally a third enclosure to the second pinch rolls.

As shown in FIG. 3, upon exiting the pinch roll stand 31, the thin cast strip may pass through second enclosure 68/76 to a hot rolling mill 32, comprising a pair of work rolls 32A and backup rolls 32B, where the cast strip is hot rolled to reduce the strip to a desired thickness, improve the strip surface, and improve the strip flatness. The rolled strip then passes onto a run-out table 33, where it may be cooled by contact with water supplied via water jets 90 or other suitable means (not shown), and by convection and radiation. In any event, the rolled strip may then pass through a second pinch roll stand 91 having rollers 91A to provide tension of the strip, and then to a coiler.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the twin roll caster and forms part of a sealed first enclosure 27 as described below. At this time, a water-cooled apron 28 that normally hangs downwardly from a pivot 29 to one side in the first enclosure 27 is swung into position to guide the clean end of the cast strip 21 onto the guide table 30 where the strip is fed through the pinch roll stand 31. The apron 28 is then retracted back to its hanging position to allow the cast strip 21 to hang in a loop (shown in FIG. 1) beneath the casting rolls in the first enclosure 27, before the strip passes to the guide table 30 where it engages a succession of guide rollers. An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations.

The first enclosure 27 is typically water cooled. The sealed first enclosure 27 is formed by a number of separate wall sections that fit together at various seal connections to form a continuous enclosure wall that permits control of the atmosphere within the enclosure. Additionally, the scrap receptacle 26 may be capable of attaching with the first enclosure 27 so that the first enclosure is capable of supporting a protective atmosphere immediately beneath the casting rolls 12 in the casting position. The first enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the first enclosure 27, the opening being positioned above the scrap receptacle 26 in the scrap receiving position.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the first enclosure 27 and movable away from or otherwise disengageable from the scrap receptacle as desired.

A lower plate may be operatively positioned within or adjacent the lower enclosure portion 44 to permit further control of the atmosphere within the enclosure when the scrap receptacle 26 is moved from the scrap receiving position and provides an opportunity to continue casting while the scrap receptacle is being changed for another. The lower plate may be operatively positioned within the first enclosure 27 adapted to closing the opening of the lower portion of the enclosure, or lower enclosure portion, when the rim portion is disengaged from the scrap receptacle. Then, the lower plate may be retracted when the rim portion 45 sealingly engages the scrap receptacle to enable scrap material to pass downwardly through the first enclosure 27 into the scrap receptacle 26. The lower plate may be in two plate portions, pivotably mounted to move between a retracted position and a closed position, or may be one plate portion as desired. A plurality of actuators (not shown) such as servo-mechanisms, hydraulic mechanisms, pneumatic mechanisms and rotating actuators may be suitably positioned outside of the first enclosure 27 adapted to moving the lower plate in whatever configuration between a closed position and a retracted position. When sealed, the first enclosure 27 and scrap receptacle 26 are filled with a desired gas, such as nitrogen, to reduce the amount of oxygen in the enclosure and provide a protective atmosphere for the cast strip.

The first enclosure 27 may include an upper collar portion 27A supporting a protective atmosphere immediately beneath the casting rolls in the casting position. The upper collar portion 27A may be moved between an extended position adapted to supporting the protective atmosphere immediately beneath the casting rolls and an open position enabling an upper cover to cover the upper portion of the enclosure 27. When the roll cassette 11 is in the casting position, the upper collar portion is moved to the extended position closing the space between a housing portion adjacent the casting rolls 12 (as shown in FIG. 2), and the first enclosure 27 by one or a plurality of actuators (not shown) such as servo-mechanisms, hydraulic mechanisms, pneumatic mechanisms, and rotating actuators. The upper collar portion may be water cooled.

The upper cover may be operably positioned within or adjacent the upper portion of the first enclosure 27 capable of moving between a closed position covering the enclosure and a retracted position enabling cast strip to be cast downwardly from the nip into the first enclosure 27 by one or more actuators, such as servo-mechanisms, hydraulic mechanisms, pneumatic mechanisms, and rotating actuators. When the upper cover is in the closed position, the roll cassette 11 may be moved from the casting position without significant loss of the protective atmosphere in the enclosure. This enables a rapid exchange of casting rolls, with the roll cassette, since closing the upper cover enables the protective atmosphere in the enclosure to be preserved so that it does not have to be replaced.

The casting rolls 12 are counter-rotated through drive shafts by an electric motor and transmission (not shown) mounted on the main machine frame. The casting rolls 12 have copper peripheral walls formed with an internal series of longitudinally extending and circumferentially spaced water cooling passages, supplied with cooling water through the roll ends from water supply ducts in the shaft portions, which are connected to water supply hoses through rotary joints (not shown). The casting rolls 12 may be between about 450 and 650 millimeters in diameter. Alternatively, the casting rolls 12 may be up to 1200 millimeters or more in diameter. The length of the casting rolls 12 may be up to about 2000 millimeters, or longer, in order to enable production of strip product of about 2000 millimeters width, or wider, as desired in order to produce strip product approximately the width of the rolls. Additionally, the casting surfaces may be textured with a distribution of discrete projections, for example, random discrete projections as described and claimed in U.S. Pat. No. 7,073,565 and having the tapered distribution of surface roughness described therein. The casting surface may be coated with chrome, nickel, or other coating material to protect the texture.

Cleaning brushes 36 are disposed adjacent the pair of casting rolls, such that the periphery of the cleaning brushes 36 may be brought into contact with the casting surfaces 12A of the casting rolls 12 to clean oxides from the casting surfaces during casting. The cleaning brushes 36 are positioned at opposite sides of the casting area adjacent the casting rolls, between the nip 18 and the casting area where the casting rolls enter the protective atmosphere in contact with the molten metal casting pool 19. Optionally, separate sweeper brushes 37 may be provided for further cleaning the casting surfaces 12A of the casting rolls 12, for example at the beginning and end of a casting campaign as desired.

The side dams 20 may be mounted on and actuated by plate holders positioned one at each end of the roll assembly and moveable toward and away from one another. The plate holders of side dams 20 may be positioned on a core nozzle plate mounted on the roll cassette 11 so as to extend horizontally above the casting rolls. The core nozzle plate is positioned beneath the distributor 16 in the casting position and has a central opening to receive the metal delivery nozzle 17. The metal delivery nozzle 17 may be provided in two or more segments, and at least a portion of each metal delivery nozzle 17 segment may be supported by the core nozzle plate. The outer end of each metal delivery nozzle 17 is supported by a bridge portion (not shown) positioned adjacent the side dams 20 and capable of supporting and moving the delivery nozzle 17 during casting.

A knife seal may be provided adjacent each casting roll 12 and adjoining the housing portion. The knife seals may be positioned as desired near the casting roll and form a partial closure between the housing portion and the rotating casting rolls 12. The knife seals enable control of the atmosphere around the brushes, and reduce the passage of hot gases from the enclosure 27 around the casting rolls. The position of each knife seal may be adjustable during casting by causing actuators such as hydraulic or pneumatic cylinders to move the knife seal toward or away from the casting rolls.

The casting rolls 12 are internally water cooled so that as the casting rolls 12 are counter-rotated, shells solidify on the casting surfaces 12A as the casting surfaces rotate into contact with and through the casting pool 19. During casting, metal shells formed on the casting surfaces of the casting rolls are brought together at the nip to deliver cast strip downwardly from the nip into the first enclosure 27. Between the casting rolls and pinch roll stand 31, the newly formed steel strip is enclosed within the first enclosure 27 defining a sealed space or atmosphere.

Referring now to FIG. 3, after passing through pinch roll stand 31, the strip 21 enters the first part 68 of second enclosure 68/76 and is supported by the guide table 30 to the rolling mill 32. An anti-crimping guide roll 70 may be located immediately in advance of the rolling mill 32, operable to be raised and lowered to lift the cast strip out of its straight line horizontal path so as to pass around the anti-crimping roll and to be wrapped about the upper work roll 32A in advance of the roll bite between the work rolls 32A. To hold the strip down on the guide table 30 when the anti-crimping roll 70 is raised, a pass line roll 72 is brought downwardly to engage the strip 21 against the guide table 30. The second enclosure 68/76 generally running between the pinch roll stand 31 and the rolling mill 32.

The atmosphere in the first part 68 of the second enclosure 68/76 may be separate from the atmosphere in the first enclosure 27. Alternatively, the atmosphere in the first part 68 of enclosure 68/76 may be substantially the same as the atmosphere in the first enclosure 27. In any case, the downstream part 76 of second enclosure 68/76 extends from the first part 68 of second enclosure 68/76 to the rolling mill stand 32. The cast strip 21 continues to be enclosed in the protective atmosphere of second enclosure 68/76 in the downstream part 76 between the pass line roll 72 and the hot rolling mill 32. A controlled atmosphere may be maintained in both the first enclosure 27 and the second enclosure 68/76 to control the oxidation on the surface of the cast strip 21. Scale on the surface of the strip 21 decreases the friction coefficient of the cast strip 21.

The scrap receptacle 26, first enclosure 27 and second enclosure 68/76 are not completely sealed so as to prevent leakage, but rather are usually sufficiently sealed to a practical degree with undue expense allowing control and support of the atmosphere within these enclosures as desired and with some tolerable leakage. As such, the supply of nitrogen into the first and second enclosures also may be controlled to limit the amount of air ingress.

The second enclosure 68/76 may be fitted with water spray inlets 101 operable to spray a fine mist of water droplets adjacent the surface of the steel strip as it passes through the second enclosure 68/76, and thereby to generate steam and humidity within the second enclosure while tending to avoid liquid water contact with the steel strip. Gas inlets 101 may be disposed in the lid or top portion 61 and 89 of the first part 68 and downstream part 76 of second enclosure 68/76, and disposed laterally across the lid such that they are arranged to provide a more even distribution of oxygen-containing gas across the width of the strip 21 and form a more even scale thickness on at least one surface of the cast strip 21. Each inlet 101 may be independently controlled to more evenly direct an oxygen-containing gas having a desired amount of oxygen and other elements onto the cast strip 21 at desired locations.

The inlets 101 may be operable with a gas propellant to produce a fine mist of water. The water may be supplied at around 100-500 kPa pressure, although the pressure of the water is not critical. Accordingly, the inlets 101 may be set up to produce a fine mist spray across the width of the strip 21 to generate steam and humidity within the second enclosure 68/76. In one alternative, the gas propellant for the water through inlets 101 may be an inert gas such as nitrogen.

In second enclosure 68/76, a desired, reduced more even friction coefficient is established across the strip 21 by providing more even contact between the strip and the work rolls 32A by controlling the oxygen and humidity levels. Oxygen gas is introduced to provide 0.5% and 15% oxygen and moisture to provide a humidity between 3% and 10% in the atmosphere of the second enclosure 68/76 to cause the strip 21 to form a scale of a desired thickness across the width of the strip 21, and in turn a desired friction coefficient across the width of the strip 21 prior to entering the rolling mill stand 32. More specifically, the atmosphere in the second enclosure may comprise between 3 and 7% oxygen inclusive or between 5 and 10 or 15% oxygen inclusive, with a humidity between 3% and 10% or between 3% and 5% in the second enclosure.

In the second enclosure 68/76, the scale on the strip 21 may be between 0.05 microns and 4.0 microns or between 0.2 and 2.0 microns in thickness. The desired scale level provides a desired friction factor across the width of the strip improving control of the strip at the rolling mill 32 and downstream therefrom to the coiler. Detection devices, such as thermal cameras, may be implemented to measure the emissivity of the strip indicating the thickness of scale build-up on the strip surface.

In some embodiments, the gas inlets 101 may be disposed in the top portion or the bottom portion of the second enclosure 68/76, adapted to direct oxygen-containing gas downwardly or upwardly toward the strip 21 to provide an atmosphere between 0.5% and 10% oxygen while providing humidity between 3% and 10% in the second enclosure to more evenly oxidize over at least one surface of the cast strip 21. In alternative embodiments, the gas inlets 101 may be disposed within both the bottom portion and top portion of the second enclosure 68/76 adapted to deliver oxygen-containing gas toward the upper and lower opposed surfaces of the cast strip 21. In either event, the gas inlets may be adapted to deliver oxygen-containing gas generally into the first part 68 and the downstream part 76 of the second enclosure 68/76.

Figure 4:
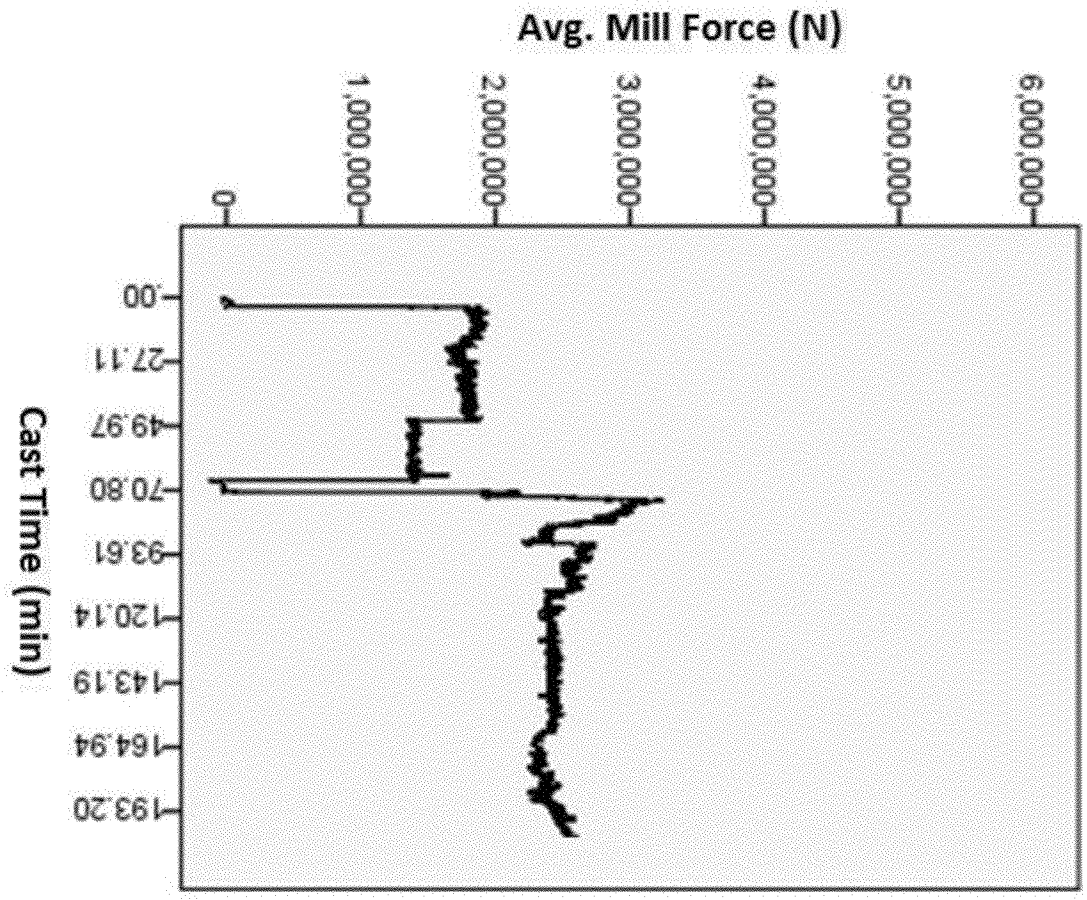
FIG. 4 is a graph showing an example of the mill force on the strip as the strip passes through the mill with time, with and without oxygen and humidity control in an enclosure entry the roll mill.
Figure 5:
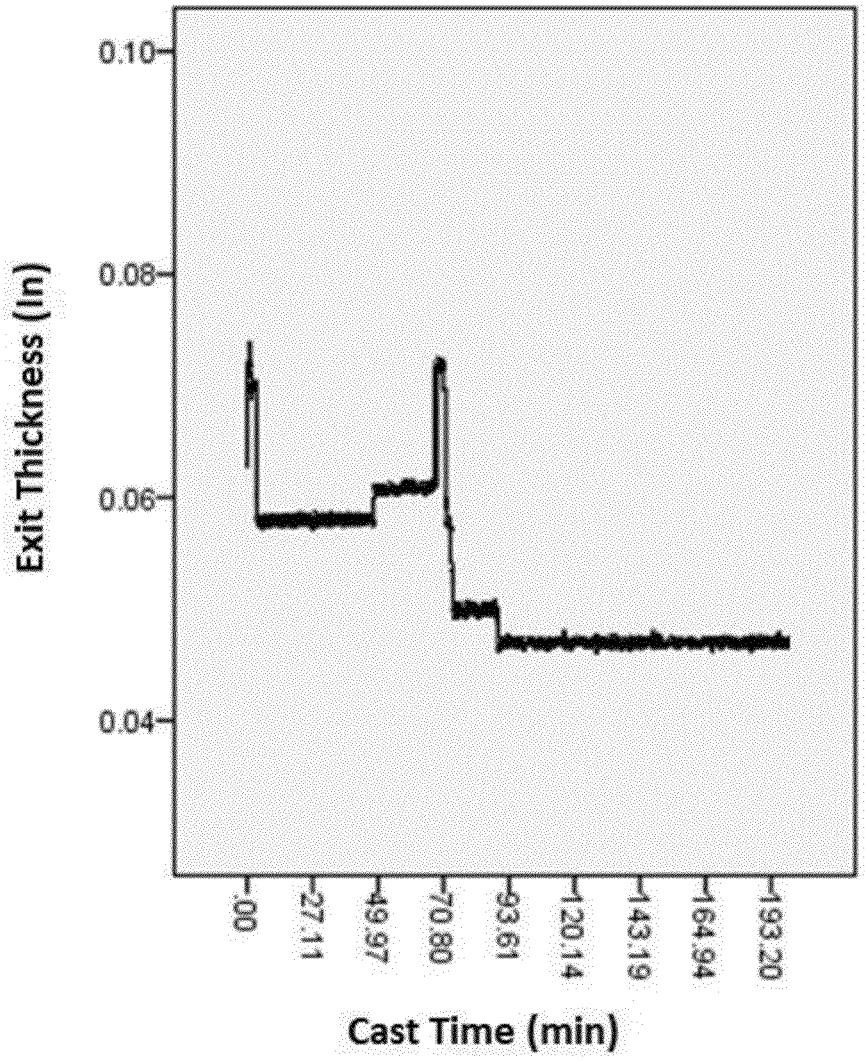
FIG. 5 is a graph showing an example of the mill exit reduction thickness of the cast strip after passing through the rolling mill stand, with and without oxygen and humidity control in an enclosure entry the roll mill.

FIG. 4 is a graph showing the mill force of the cast strip in the rolling mill. FIG. 4 shows at casting time 70.80 minutes, the percent oxygen and humidity was not yet controlled in the second enclosure and the average value of mill force was 3,278,000 newtons. Then as the oxygen gas and the humidity was controlled in the atmosphere in the second enclosure, the mill force reduced to below 2,500,000 newtons and maintained at that level through 193.20 cast time minutes. At the same time, FIG. 5 is a graph showing the strip thickness of the cast strip 21 as the exit from the rolling mill starts at a thickness of 0.07 inches at casting time 70.80 minutes, and reduces to a thickness of 0.047 inches. The data set forth in these graphs of FIGS. 4 and 5 confirm that the mill force to reduce the strip to a given desired strip thickness is decreased by providing controlled levels of oxygen and humidity as described above in the atmosphere of the second enclosure 68/76.

We also found smoother, more even strip surfaces were provided with control of the percent of oxygen and humidity in the atmosphere of the second enclosure. This is shown in Table I below.

TABLE I

| Seq no | STRIP SURFACE ROUGHNESS um | | | | | | | Second Enclosure | Second Enclosure |
|---|---|---|---|---|---|---|---|---|---|
| Heat | 1 | 2 | 3 | 4 | 5 | 6 | 7 | moisture % | oxygen % |
| 1726 | 1.10 | 1.50 | 1.40 | 1.80 | 3.00 | | | 2.06 | 1.84 |
| 1729 | 1.10 | 1.20 | 1.00 | 1.70 | 4.10 | | | 3.71 | 3.71 |
| 1728 | 0.80 | 0.80 | 0.80 | 0.80 | 0.80 | 0.90 | 0.90 | 3.68 | 5.8 |
| 1731 | 0.80 | 0.70 | 0.90 | 1.00 | 0.90 | 1.00 | | 3.68 | 5.6 |

In any case, the more even scale improves the mill loading for a desired thickness reduction, provides smoother strip surfaces, and improves steering control of the strip through the rolling mill stand 32 and downstream through the pinch roll stand 91 to the coiler. By contrast, in previous casting without control of oxygen and humidity levels in the second enclosure, an uneven layer of scale, providing a non-uniform friction coefficient between the strip and rolls will allow the work rolls 32A and pinch rolls 91A, applying a rotational force on the cast strip 21 as it passes through the rolling mills stand 32 and pinch rolls 91A and moving the strip right or left, wedging or cambering, or in an extreme event cobbling at the mill exit causing shutdown of the mill.

In addition, the second enclosure 68/76 may be adapted to selectively inhibit the ingress of atmospheric air into the enclosure 68/76. For example, to inhibit the ingress of ambient atmosphere into the enclosure 68/76, the lid 89 in the downstream part 76 of the second enclosure 68/76 may comprise a seal, such as a knife seal, around the edges of the lid 89, when the lid 89 is closed, thereby permitting control of the atmosphere within the second enclosure 68/76.

Referring to FIG. 3, when the strip 21 exits the rolling mill 32, the strip 21 may enter a third enclosure 80 or exit into the ambient atmosphere. As with the first enclosure 27 and second enclosure 68/76, the third enclosure 80 may be purged of air with nitrogen prior to the commencement of casting to have a desired atmosphere 81. The third enclosure 80 may also comprise inlets adapted to spray water onto the strip 21. The third enclosure 80 houses the strip 21 between the rolling mill stand 32 and the second pinch roll stand 91. The pinch rolls 91A are adapted to impart tension into the cast strip 21 to facilitate the coiling of the strip 21 by the coiler 92 (shown in FIG. 1).

As shown by Table I, when the oxygen levels were above 5% and the humidity was greater than 3.6% humidity, the surfaces of the cast strip were much smoother even with the 6th or 7th ladles in the casting sequence. By contrast, as shown in Table I, in previous casting without control of oxygen levels and humidity levels in the second enclosure, the surfaces of the cast strip were too rough (above an Ra of 2) after 5 ladles to continue the casting sequence to a 6th ladle and a 7th ladle. This data shows the present method and apparatus provide smoother strip surfaces, a more desirable strip product, and extends the casting sequence to 6th and 7th ladles, increasing production efficiency of the caster and improving production yield.

Figure 6:
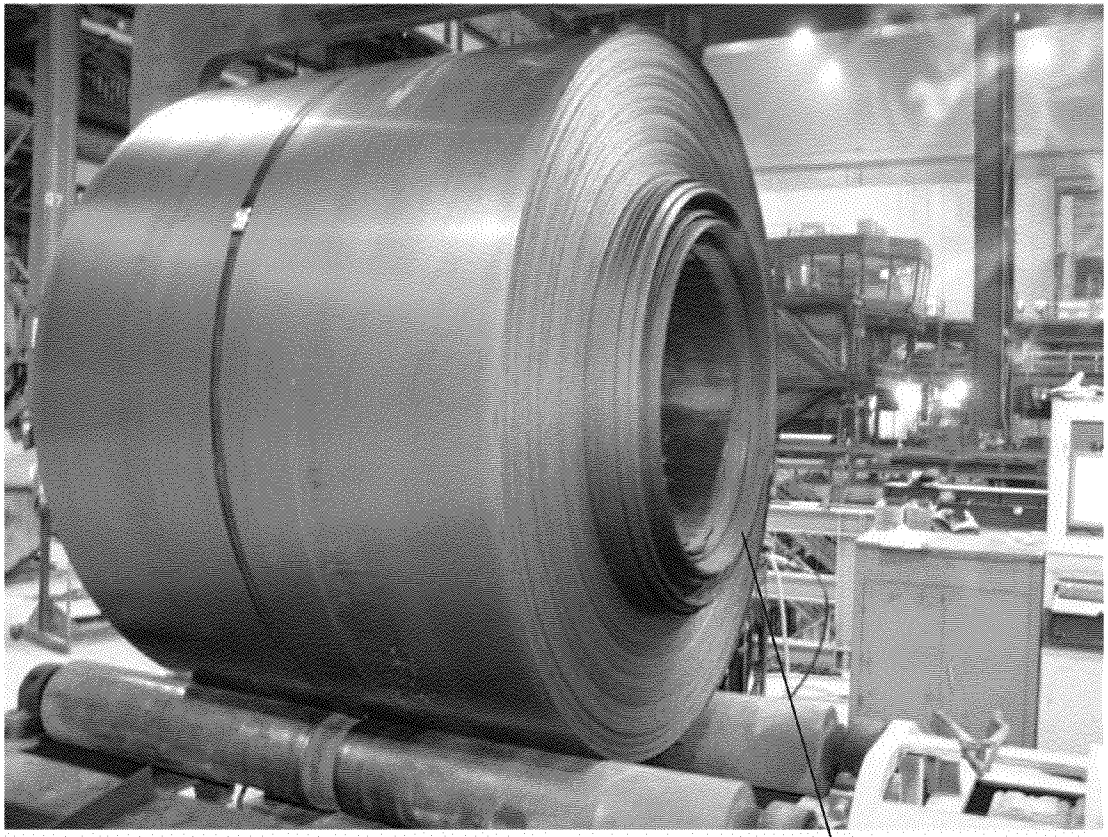
FIG. 6 is a photograph of a production coil showing an example of the more stable steering control.

FIG. 6 also shows that with the present method and apparatus, improved steering control of the cast strip can be provided through the rolling mill and downstream onto the coiler with control of the percent of oxygen and humidity in the atmosphere in the second enclosure in accordance with the present method and apparatus. As seen from FIG. 6, where the oxygen level and humidity are not controlled in the second enclosure, the strip wandered downstream of the rolling mill before coiling and telescoped as the strip as coiled as shown at 113. Then when control of oxygen levels and humidity in the second enclosure were introduced, the strip tracked as coiled as shown by the substantially straight side walls on the coil as shown in FIG. 6. Thus, this method and apparatus also substantially reduces yield losses with edge damage from telescoping in the coils.

Figure 7:
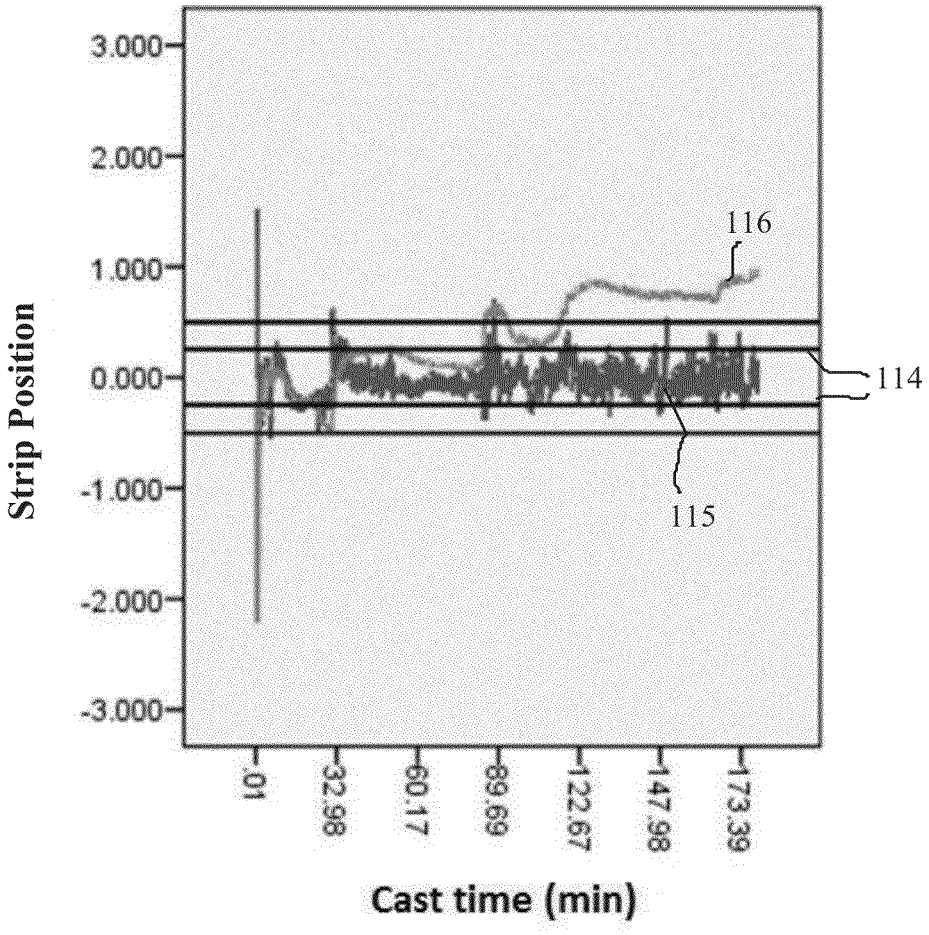
FIG. 7 is a graph showing the lateral movement of the cast strip in relation to casting time shown in FIG. 6 with and without oxygen and humidity control in an enclosure entry the roll mill.

FIG. 7 shows graphically the amount of lateral movement of the strip as it passes through the rolling mill. Lines 114 show the desired limits of lateral movement of the strip passing through the rolling mill. Lines 115 shows the position of the strip and the degree of movement as it passed through the rolling mill, and line 116 shows the position of the first pinch rolls between the first and second enclosures during the casting campaign. As shown in FIG. 7, from casting time 0.01 to 32.98 minutes in the casting sequence without oxygen and humidity control in the enclosure before entry to the roll mill, the strip is unstable, wandering left and right outside desired limits of lateral movement of the strip. This wandering of the strip causes telescoping as shown in first part 113 during coiling as shown in FIG. 6. At casting time 32.98 to 173.39 in minutes of the casting sequence, the oxygen and humidity are controlled in the enclosure at entry to the roll mill, with the parameters described above, and the steering of the strip is stable and the sides of the coil are straight as shown in FIG. 6. FIGS. 6 and 7 thus show the improvement in strip steering and the resulting improvement in quality and yield of the cast strip with the present method and apparatus. These benefits are in addition to the reduction in the mill load for a given reduction and smoother strip surfaces as described above with the present method and apparatus.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments falling within the scope of the appended claims.

What is claimed is:

1. A method of improving control of thin metal strip produced by continuous casting comprising:

assembling a continuous casting apparatus having a pair of counter-rotating casting rolls, positioned to provide a nip therebetween and at least two enclosures downstream from the nip, introducing molten metal to form a casting pool supported on the casting rolls above the nip and counter-rotating the casting rolls to form thin metal strip downwardly from the nip, guiding the strip through a first enclosure downstream from the nip, through a set of pinch rolls into a second enclosure providing entry to a rolling mill, and directing oxygen-containing gas having a desired amount of oxygen through gas inlets into the second enclosure to provide an atmosphere of 0.5 and 15% oxygen with humidity between 3% and 10% in the second enclosure to form a desired thickness of scale on the surface of the strip providing reduced mill load and downstream steering control of the strip.

2. The method of improving control of thin metal strip produced by continuous casting as claimed in claim 1 where the atmosphere in the second enclosure comprises between 5% and 10% oxygen inclusive.

3. The method of improving control of thin metal strip produced by continuous casting as claimed in claim 1 where the atmosphere in the second enclosure comprises between 3% and 7% oxygen inclusive.

4. The method of improving control of thin metal strip produced by continuous casting as claimed in claim 1 where the humidity in the second enclosure is between 3 and 5%.

5. The method of improving control of thin metal strip produced by continuous casting as claimed in claim 1 where the scale has a thickness of between 0.05 and 4.0 microns.

6. The method of improving control of thin metal strip produced by continuous casting as claimed in claim 1 where the scale has a thickness of between 0.2 and 2.0 microns.

7. The method of improving control of thin metal strip produced by continuous casting as claimed in claim 1 where the gas inlets are disposed in the bottom portion of the second enclosure directing oxygen-containing gas upwardly toward the surface of the strip.

8. The method of improving control of thin metal strip produced by continuous casting as claimed in claim 1 where the gas inlets are positioned in the top portion of the second enclosure directing oxygen-containing gas downwardly toward the surface of the thin metal strip.

9. The method of improving control of thin metal strip produced by continuous casting as claimed in claim 1 where the gas inlets are positioned in the bottom portion of the second enclosure directing oxygen-containing gas upwardly toward the surface of the thin metal strip and where the gas inlets are also positioned in the top portion of the second enclosure directing oxygen-containing gas downwardly toward the surface of the thin metal strip.

10. The method of improving control of thin metal strip produced by continuous casting as claimed in claim 1 where the oxygen-containing gas delivered through the gas inlets into the second enclosure to provide an atmosphere of 5% and 15% oxygen with humidity between 3% and 10% in the second enclosure.

11. The method of improving control of thin metal strip produced by continuous casting as claimed in claim 1 where the oxygen-containing gas delivered through the gas inlets into the second enclosure to provide an atmosphere of 3% and 7% oxygen with humidity between 3% and 10% in the second enclosure.

12. The method of improving control of thin metal strip produced by continuous casting as claimed in claim 1 where the second enclosure is adapted to inhibit ingress of atmospheric air into the enclosure.

13. The method of improving control of thin metal strip produced by continuous casting as claimed in claim 1 where the gas inlets are adapted to deliver oxygen-containing gas to the second enclosure to form between 0.05 and 4.0 microns of scale on at least one surface of the thin metal strip.

14. The method of improving control of thin metal strip produced by continuous casting as claimed in claim 1 where the gas inlets are adapted to deliver oxygen-containing gas to the second enclosure to form between 0.2 and 2.0 microns of scale on at least one surface of the thin metal strip.

* * * * *